US006426726B1

(12) United States Patent
Yablon

(10) Patent No.: US 6,426,726 B1
(45) Date of Patent: Jul. 30, 2002

(54) POLARIZED PHASED ARRAY ANTENNA

(75) Inventor: William B. Yablon, Elkridge, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/930,346

(22) Filed: Aug. 15, 2001

(51) Int. Cl.[7] ..... H01Q 19/08
(52) U.S. Cl. ..... 343/754; 343/844; 343/853
(58) Field of Search ..... 343/753, 754, 343/776, 853, 909, 844; H01Q 21/00, 19/08

(56) References Cited

U.S. PATENT DOCUMENTS 5,729,239 A * 3/1998 Rao ..... 343/753

* cited by examiner

*Primary Examiner*—Michael C. Wimer

(57) ABSTRACT

A dual polarized single axis scanned phased array antenna includes a predetermined number of mutually adjacent radiating columns which generate respective beams scannable in azimuth while providing a fixed beam in elevation, and wherein each radiating column utilizes a low loss dielectric slab assembly to serve multiple functions. The slab assembly serves, among other things, as a lens to correct the spherical wave from a small feed to a plain wave within a column. The slab assembly also includes a septum polarizer necessary to carry both horizontally and vertically polarized fields. The slab assembly additionally includes a dielectric radiator element to provide a radiating surface without the need to form a ground plane. The dielectric slab assembly, moreover, inherently loads the radiating columns so that they can be spaced one half of a free space wavelength without cutting off the vertically polarized fields.

19 Claims, 6 Drawing Sheets

FIG.6A
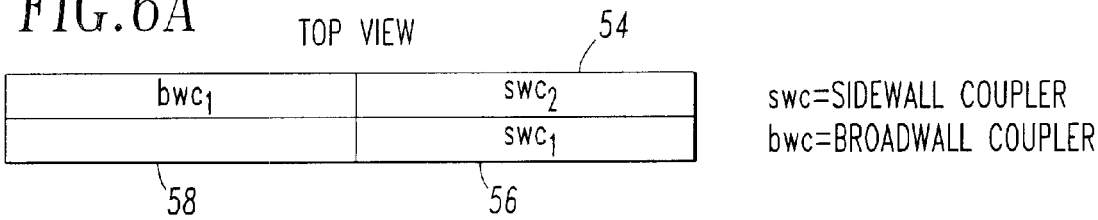
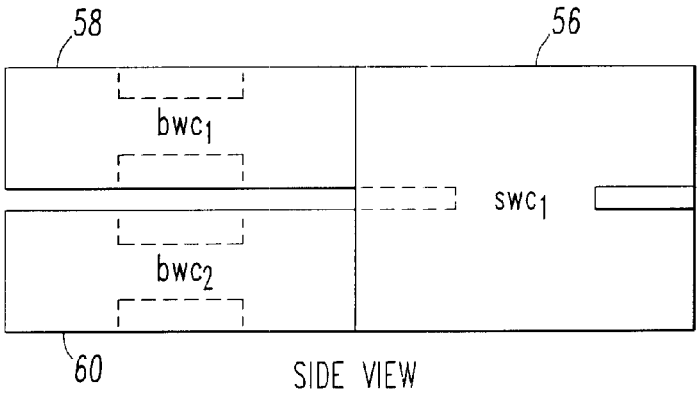
FIG.6B
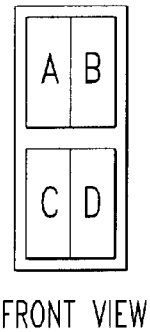
FIG.6C
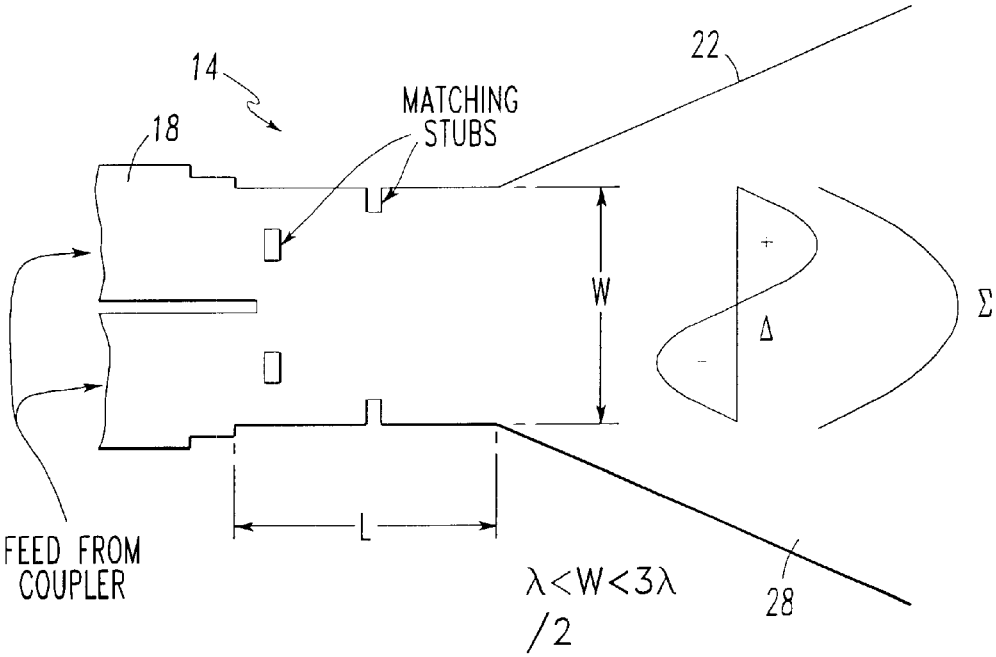
FIG.7

POLARIZED PHASED ARRAY ANTENNA

BACKGROUND OF THE INVENTION

1. Field of the Invention

This invention relates generally to phased array antennas and more particularly to a phased array antenna that provides simultaneous dual polarization operation.

2. Description of Related Art

There are applications that require a low cost phased array antenna that provides simultaneous dual polarization operation. This requires the antenna to have radiators that can radiate either vertical or horizontal polarization. Accordingly, there must be two separate combining manifolds. These requirements place a burden on available packaging space, particularly for antennas operating in the millimeter wave frequency range or higher.

SUMMARY

It is an object of the present invention, therefore, to provide an improvement in phased array antennas.

It is a further object of the invention to provide a dual polarized single axis phased array antenna which is operable in the millimeter wave range of RF frequencies.

It is still another object of the invention to provide a simultaneous dual polarized phase array antenna which electrically scans a beam in azimuth while generating a fixed beam in elevation.

These and other objects are achieved by a dual polarized single axis scanned phased array antenna comprising a plurality of mutually adjacent radiating columns which generate respective beams scannable in azimuth while providing a fixed beam in elevation, and wherein each radiating column utilizes a low loss dielectric slab assembly to serve multiple functions. The slab assembly serves, among other things, as a lens to correct the spherical wave from a small feed to a plain wave within a column. The slab assembly also includes a septum polarizer necessary to carry both horizontally and vertically polarized fields. The slab assembly additionally includes a dielectric radiator element to provide a radiating surface without the need to form a ground plane. The dielectric slab assembly, moreover, inherently loads the radiating columns so that they can be spaced one half of a free space wavelength without cutting off the vertically polarized fields.

Further scope of applicability of the present invention will become apparent from the detailed description provided hereinafter. It should be understood, however, that the detailed description and specific example, while disclosing the preferred embodiment of the invention, it is provided by way of illustration only, since various changes and modifications coming within the spirit and scope of the invention will become apparent to those skilled in the art from the following detailed description.

BRIEF DESCRIPTION OF THE DRAWINGS

The present invention will become more fully understood when the detailed description of the invention provided hereinafter is considered in conjunction with the accompanying drawings which are provided by way of illustration only, and are thus not meant to be considered in a limiting sense, and wherein:

FIGS. 6A, 6B and 6C are top, side and front elevational views of the sidewall and broadwall couplers utilized in the combiner circuitry shown in FIG. 5;

FIG. 7 is a diagram illustrative of in-phase and out-of-phase wavefronts emanating from the feed portion of the antenna section shown in FIG. 4

DESCRIPTION OF THE PREFERRED EMBODIMENTS

Figure 1:
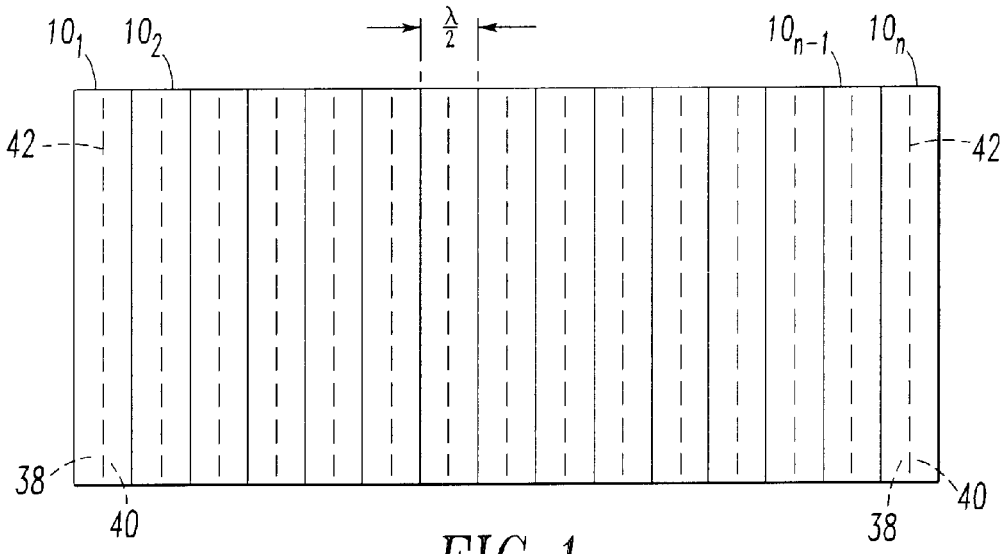
FIG. 1 is a partial front planar view illustrative of a dual polarized array antenna in accordance with the preferred embodiment of the invention.

Referring now to the drawings wherein like reference numerals refer to like elements, FIG. 1 is illustrative of a single axis electrically scanned phased array consisting of a predetermined number of mutually adjacent sections of radiator elements $\mathbf{10}_1$, $\mathbf{10}_2$, . . . $\mathbf{10}_{n-1}$, $\mathbf{10}_n$. The sections are in the form of parallel columns of radiators of equal height. The vertical dimension may be many wavelengths long; however, the horizontal or width dimension are equal and close to one half wavelength ($\lambda/2$) of the intended operating frequency to facilitate azimuth beam scanning without grating lobes being generated. Thus each elongated antenna section or column $\mathbf{10}_1$, . . . $\mathbf{10}_n$ respectively form a narrow fixed beam in elevation which is electrically scanned in azimuth.

The beam is formed using the concept of a convex lens to correct cylindrical waves radiated by an electrically small feed. As will be shown hereinafter, the lens is comprised of a low loss column of dielectric material that is relatively thick at the center and thin at the ends. This type of phase correcting technique is well known and is used as a building block for each antenna section 10, one of which is shown, for example, in FIG. 2.

Referring now collectively to FIGS. 2, 3, 4, and 5, each antenna section or column 10 of the array shown in FIG. 1 is comprised of a four port sum (Σ) and difference (Δ) signal combiner 11, an electrically small signal feed 12, a lens and cavity section 13, a signal polarizer 14, and a radiator 15.

Figure 2:
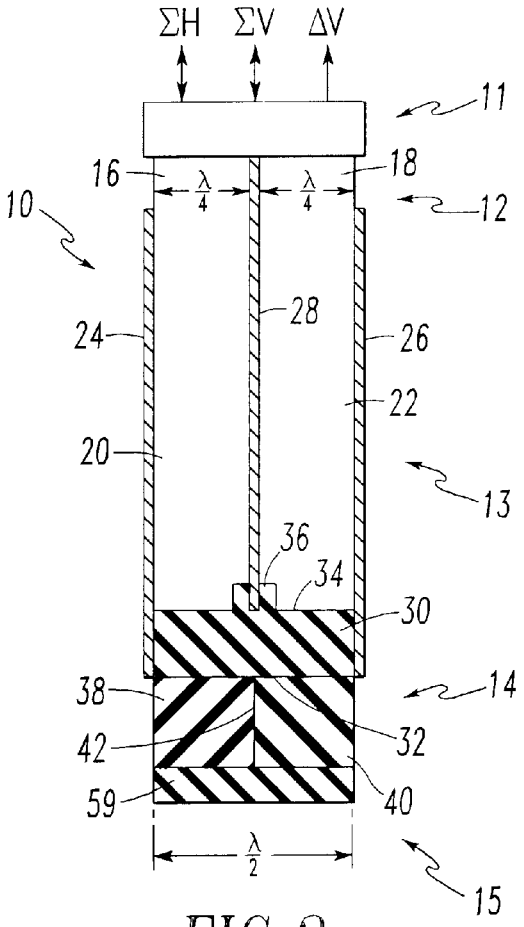
FIG. 2 is a central longitudinal cross section view of one column or section of the array shown in FIG. 1.
Figure 3:
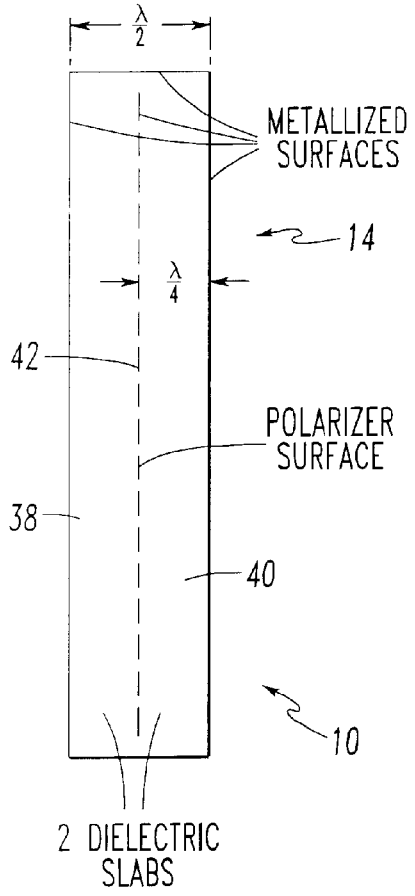
FIG. 3 is a front planar view of one pair of dielectric slabs which form the polarizer portion of the antenna section shown in FIG. 2.
Figure 4:
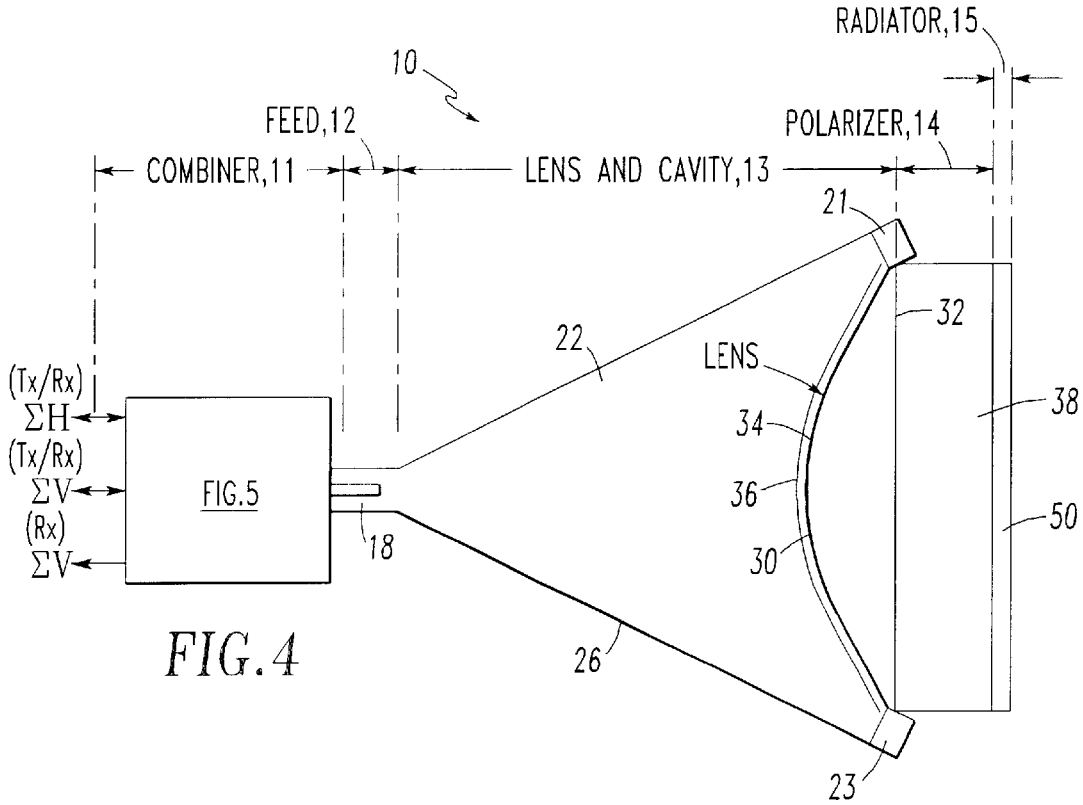
FIG. 4 is a side planar view further illustrative of the section of the array shown in FIGS. 1 and 2.

The signal combiner 11 is needed to provide dual polarization and will be considered in detail hereinafter. The signal feed 12 splits the energy into two quarter wavelength (λ/4) wide feeds 16 and 18 as shown in FIG. 2, which respectively feed two adjoining energy confining cavities 20 and 22 formed by outwardly flaring vertical metallic side walls 24 and 26 that define the half wavelength (λ/2) boundaries of the antenna section 10. Due to the free space half wavelength column spacing limitation, the feed polarization of the signals must be horizontal polarization to propagate down the parallel plate guides.

To facilitate the dual polarization requirement, a third vertical metallic wall 28 is provided to divide the cavity spacing so that two quarter wavelength (λ/4) cavities are provided at 20 and 22. At the forward end of the cavities 20 and 22 are located spillover absorber elements as shown by reference numerals 21 and 23 in FIG. 4 along with a dielectric convex lens element 30 having a generally flat outer face 32 and a convex inner face 34. The single lens element 30 acts to provide a separate quarter wavelength wide lens for each of the cavities 20 and 22 by the wall 28 and a centralized impedance matching ridge portion 36 that runs down the center of the convex face 34.

Figure 8:
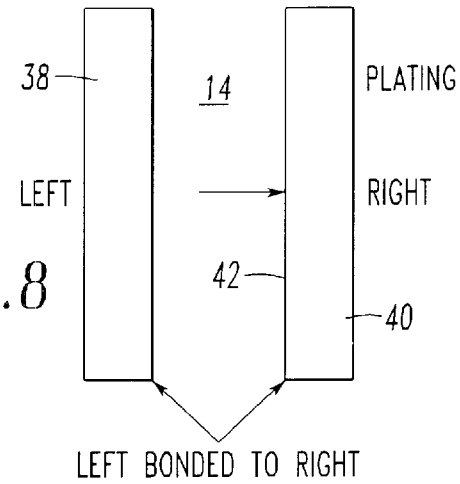
FIG. 8 is a front planar view further illustrative of the two dielectric slabs shown in FIG. 3 implementing the polarizer portion of the antenna section shown in FIG. 2.
Figure 9A:
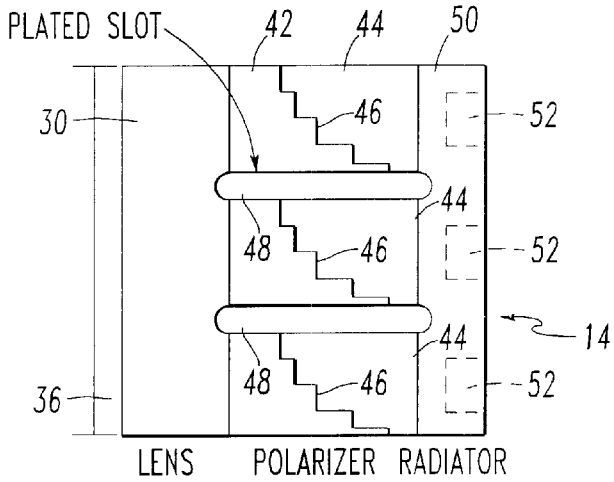
FIGS. 9A and 9B are side and front planar views illustrative of the lens, polarizer and radiator portions of the antenna section shown in FIG. 2.

In front of the dielectric lens 30 is located a polarizer section 14 consisting of two identically configured elongated dielectric slabs 38 and 40 (FIG. 3) having a horizontal width of one quarter wavelength (λ/4). The slabs 38 and 40 have metallized outer surfaces and are bonded together as shown in FIG. 8. One inner surface, for example wall surface 42 (FIG. 8), includes a metallization pattern 44 including a plurality of ramps or steps 46, shown in FIG. 9A so as to form respective polarizer sections which are separated by plated slots 48.

Figure 9B:
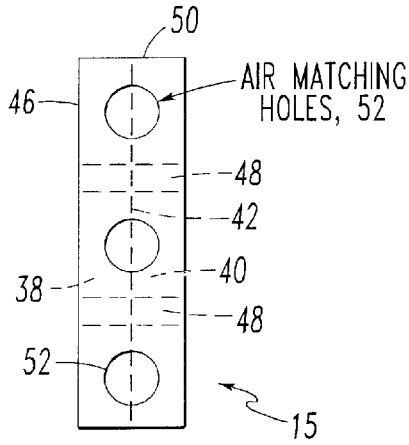

A dielectric radiator element 50 having a half wavelength (λ/2) width as shown in FIG. 2, and having length equal to the dielectric slabs 38 and 40, is located forward of the polarizer section 14. As best shown in FIG. 9B, the radiator element 50 includes a plurality of air matching holes 52 which are centrally located forward of the polarizer section steps 46 shown in FIG. 9A.

Figure 5:
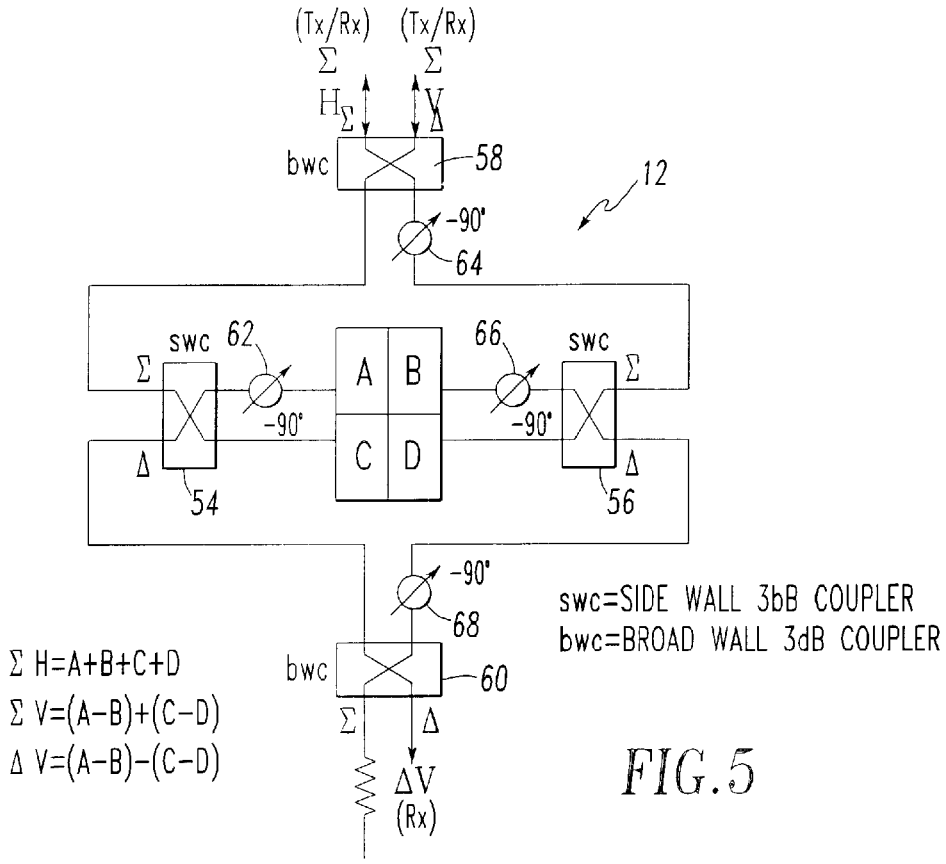
FIG. 5 is an electrical schematic diagram illustrative of the combiner circuitry shown in FIG. 4.

To facilitate dual polarization, the signal combiner network 11 is shown in FIG. 5 comprised of two sidewall 3 dB microwave couplers 54 and 56, two broadwall 3 dB couplers 58 and 60, and four 90° phase shifters 62, 64, 66, and 68. These components are interconnected as shown, while being physically oriented as shown in FIGS. 6A and 6B, so as to provide four signal feed apertures A, B, C and D which can propagate in-phase-sum (Σ) or 180° out-of-phase-difference (Δ) horizontally polarized signals within the lens cavity and lens 20, 22 and 30. It can be seen that each of the four couplers 58, 60, 62 and 64 all include Σ and Δ signal ports. Since each column antenna section 10 of the array can act as both transmitter and receiver of electrical signals, in-phase horizontal ΣH signals are coupled to and from the Σ port of coupler 58 and include signals A+B+C+D. The other port of coupler 58 comprising the Δ port is adapted to transmit or receive in-phase vertical ΣV signals comprising the combination of signals (A−B)+(C−D). Out-of-phase vertical signals (ΔV) can be received at the Δ port of coupler 60 and comprises the combination of signals (A−B)−(C−D).

Figure 10A:
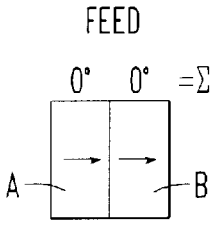
FIGS. 10A and 10B are illustrative of in-phase ($\Sigma$) and out of phase ($\Delta$) wavefronts propagating through the lens portion of the antenna section of the antenna shown in FIG. 2.
Figure 11A:
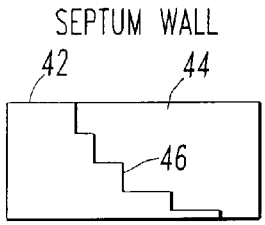
FIGS. 11A and 11B are illustrative of the effect of the system wall surface on $\Sigma$ and $\Delta$ wavefronts propagating in the polarizer portion of the antenna section shown in FIG. 9A.
Figure 12A:
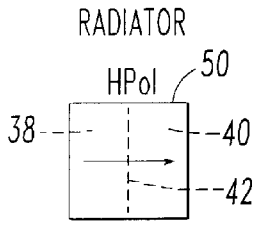
FIGS. 12A and 12B are illustrative of resulting horizontal and vertical polarization waves which propagate in the radiator portion of the antenna section shown in FIG. 2 following passage past the system wall surface shown in FIGS. 11A and 11B.
Figure 10B:
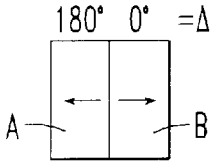
Figure 11B:
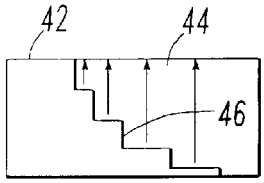
Figure 12B:
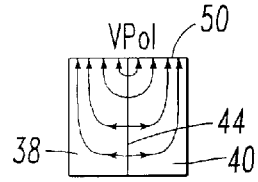

Accordingly, in-phase (Σ) and out-of-phase (Δ) horizontally polarized signals can be propagated in the cavities 20 and 22 (FIG. 2) as shown in FIG. 7. The steps 46 of the metallization pattern 44 of the polarizer section 38 serve as polarization rotation devices similar to commercial waveguide septum polarizers. Thus when two adjacent horizontally polarized feeds, for example A and B at the lens focal plane are excited in phase as shown in FIG. 10A, the planar fields in each quarter wave wide (λ/4) section radiate horizontal polarization fields as shown in FIG. 12A, while being unaffected by the metallization surface 44 of the dielectric polarizer slabs 38 and 40. This occurs due to the E-plane symmetry about the metallic common wall or septum 42. However, when two feeds A and B are excited 180° out of phase as shown, for example in FIG. 10B, the ramps or steps 46 of the metallization pattern 44 are encountered as shown in FIG. 11B and the fields rotate from horizontal to vertical polarization as shown in FIG. 12B. Thus each radiator element 50 can propagate both horizontal or vertical polarization waves of microwave RF energy.

With a plurality of columns $\mathbf{10}_1$, $\mathbf{10}_2$, . . . $\mathbf{10}_n$, being stacked horizontally across the array as shown in FIG. 1, a radiating surface is generated that can be impedance matched from dielectric to the free space. Thus it is not necessary to form a ground plane around the radiators, providing a significant assembly advantage. The dielectric elements of the lens 13, polarizer 14 and radiator members 15 are mechanically very simple and can be shaped by an injection molding process. The surfaces that require metallic boundaries can be easily metallized using established metallization processes. Furthermore, the antenna sections $\mathbf{10}_1$ . . . $\mathbf{10}_n$ can be bonded together using bond films.

Figure 13:
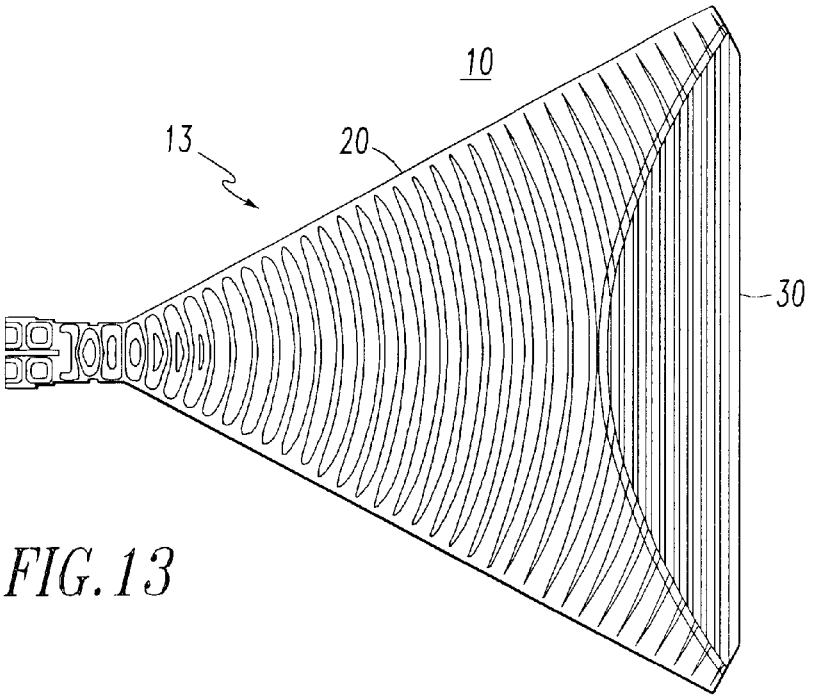
FIG. 13 is a depiction of the RF energy propagating in the antenna section shown in FIG. 4 as viewed from the side.
Figure 14:
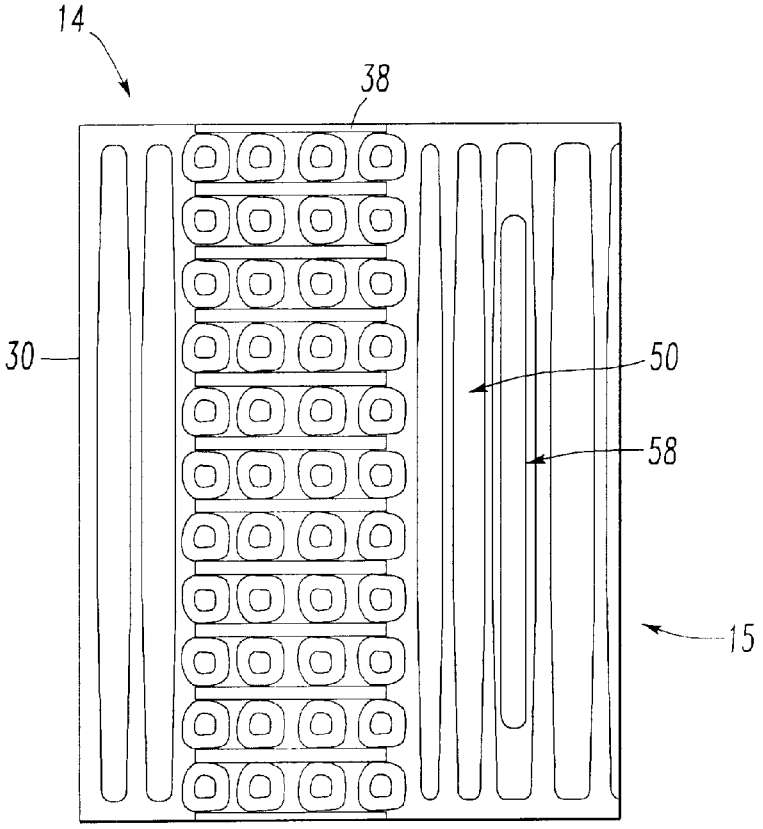
FIG. 14 is a depiction of the RF energy propagating through the polarizer and lens portion of the antenna section shown in FIG. 4.

Referring now briefly to FIGS. 13 and 14, depicted thereat is the energy propagation occurring in one of the antenna columns 10. As shown in the side planar view of FIG. 13, energy propagating with a curved wavefront within the cavity portion 20 is converted to a planar wavefront in the lens portion 30. As shown in FIG. 14, the plane wave from the lens 30 propagates through the polarizer section 38 where it encounters the dielectric radiator element which is accompanied by a dielectric/air transition region 58.

Figure 15:
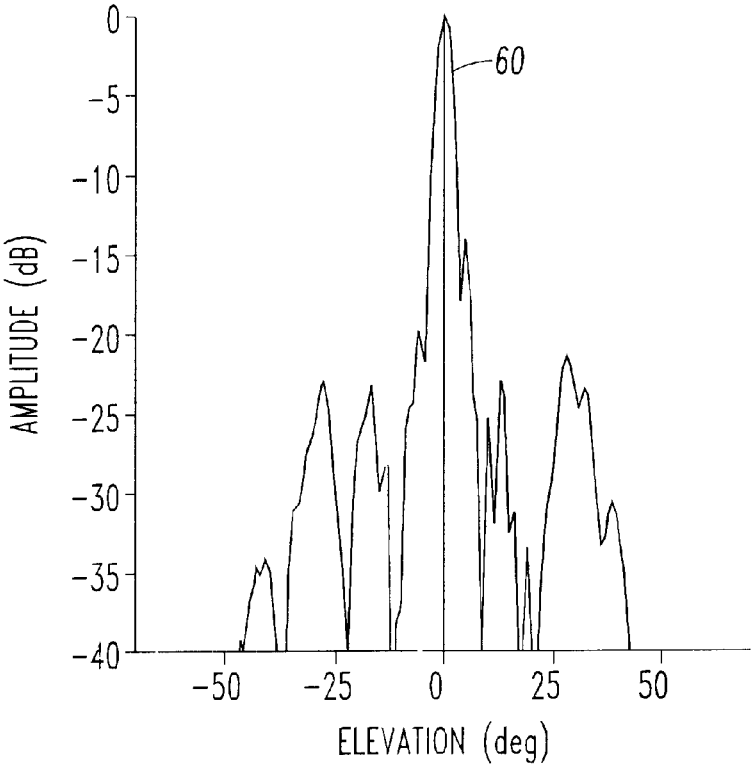
FIG. 15 is illustrative of the horizontally polarized antenna pattern of a beam generated in elevation by the antenna section shown in FIGS. 1 and 2.
Figure 16:
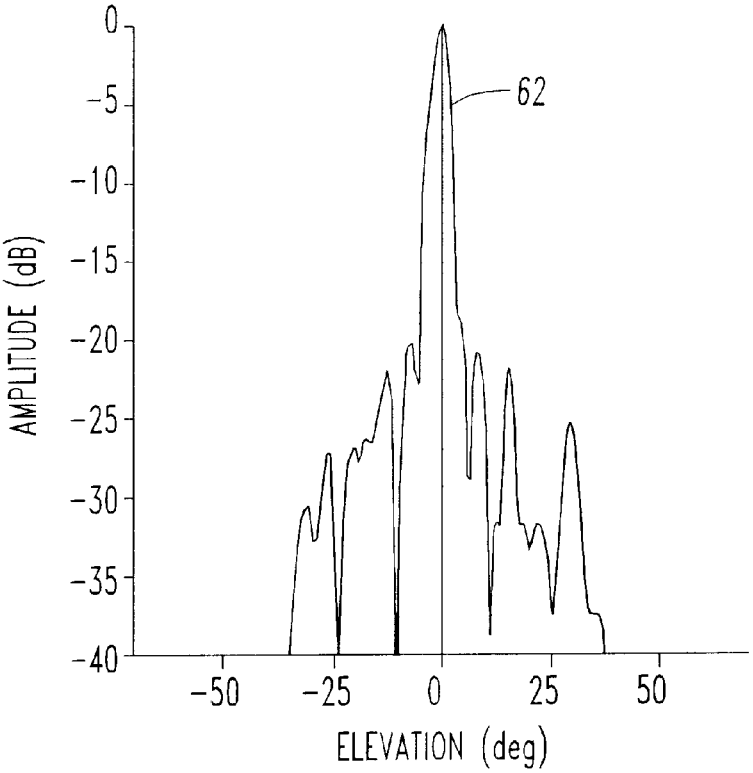
FIG. 16 is illustrative of the vertically polarized antenna pattern of a beam generated in elevation by the antenna section shown in FIGS. 1 and 2.

FIGS. 15 and 16 are illustrative of the elevation beam pattern of a single column antenna section 10 for both horizontally and vertically polarized signals. FIG. 15 depicts the horizontal polarization beam pattern which is shown by reference numeral 60 while the vertical polarization antenna pattern is shown by reference numeral 62. Both patterns exhibit similar characteristics which can be replicated across the face of the array shown in FIG. 1 in azimuth.

Accordingly, what is shown and described is a low cost dual polarized single axis scanned array that uses dielectric slab type elements to form an elevation beam in the non-scan plane and supports septum polarizer features required to provide simultaneous dual polarization operation while dielectrically loading the radiating columns.

The foregoing detailed description merely illustrates the principles of the invention. It will thus be appreciated that those skilled in the art will be able to devise various arrangements which, although not explicitly described or shown herein, embody the principles of the invention and thus are within its spirit and scope.

What is claimed is:

1. A dual polarized antenna array comprising:

a plurality of mutually adjacent elongated columns of antenna elements having a like configuration and being scannable in azimuth while having a fixed beam in elevation, said columns being greater than one or more wavelengths in length and about one half wavelength in width so as to facilitate azimuth beam scanning without the generation of any substantial grating lobes and, wherein each of the said columns include a pair of adjacent parallel plate cavities equal to or about a quarter wavelength in width extending from a dual feed manifold to a radiation assembly including a lens, a polarizer sub-assembly and a radiator element for propagating RF signals of both vertical or horizontal polarization.

2. An antenna array according to claim 1 wherein all of said columns of antenna elements are substantially equal in length.

3. An antenna array according to claim 1 wherein the pair of parallel plate cavities include two substantially flat outer walls of metallic material separated by a substantially flat intermediate inner wall also of metallic material.

4. An antenna array according to claim 1 wherein said radiation assembly is fabricated from dielectric material.

5. An antenna array according to claim 6 wherein the lens comprises a convex lens element of dielectric material having a convex inner face and a flat outer face.

6. An antenna array according to claim 5 wherein the lens element includes impedance matching means on the convex inner face.

7. An antenna array according to claim 6 wherein said impedance matching means comprises a centralized raised portion of dielectric material extending from top to bottom of the lens element.

8. An antenna array according to claim 6 wherein the polarizer sub-assembly includes a pair of dielectric slabs joined together and having a polarizer surface therebetween.

9. An antenna array according to claim 8 wherein the pair of dielectric slabs are generally rectangular in shape and have metallized top, side and bottom surfaces.

10. An antenna array according to claim 9 wherein the polarizer sub-assembly matches the lens element in height.

11. An antenna array according to claim 8 wherein the polarizer surface comprises a septum wall having at least one pattern of metallization including a set of step segments extending downwardly from the lens toward the radiator element.

12. An antenna array according to claim 11 wherein said at least one pattern of metallization comprises a plurality of metallization patterns respectively separated by metallized slots.

13. An antenna array according to claim 6 wherein the radiator element comprises a dielectric slab of dielectric material located in front of the polarizer sub-assembly.

14. An antenna array according to claim 13 wherein the radiator element is generally rectangular in shape and matches the polarizer sub-assembly in height.

15. An antenna array according to claim 16 wherein the radiator element includes air matching hole means in the front or outer surface thereof.

16. An antenna array according to claim 1 wherein the dual feed manifold includes an in-phase and 180° out-of-phase signal combiner.

17. An antenna array according to claim 16 wherein the signal combiner includes a plurality of microwave signal couplers interconnected to a plurality of 90° phase shifters so as to provide four RF signal apertures.

18. An antenna array according to claim 17 wherein said microwave signal couplers include two first type signal couplers and two second type signal couplers.

19. An antenna array according to claim 18 wherein the first type signal couplers comprise sidewall signal couplers and the second type signal couplers comprise broadwall signal couplers.

* * * * *